US005386986A

United States Patent [19]

Gamboa

[11] Patent Number: 5,386,986

[45] Date of Patent: Feb. 7, 1995

[54] BASEBALL BATTING PRACTICE DEVICE

[76] Inventor: Ricardo Gamboa, 4323 Hauck St., Los Angeles, Calif. 90063

[21] Appl. No.: 13,635

[22] Filed: Feb. 4, 1993

[51] Int. Cl.[6] ..... A63B 69/40

[52] U.S. Cl. ..... 273/26 E; 273/29 R; 273/58 C

[58] Field of Search ..... 273/26 E, 29 A, 413, 273/414, 58 C; 482/15

[56] References Cited

U.S. PATENT DOCUMENTS

| | | | |
|---|---|---|---|
| 2,805,062 | 9/1957 | Holmes | 482/15 |
| 2,976,040 | 3/1961 | Bales . | |
| 3,366,383 | 1/1968 | Lentine . | |
| 3,425,700 | 2/1969 | Edwards | 273/58 C |
| 3,593,998 | 7/1971 | Pattyn | 273/29 A |
| 3,637,209 | 1/1972 | Raut . | |
| 3,716,235 | 2/1973 | Yerkie, Jr. . | |
| 3,731,925 | 5/1973 | Caldwell | 273/58 C |
| 3,731,927 | 5/1973 | Russo, Jr. | 273/58 C |
| 3,825,259 | 7/1974 | Burchett . | |
| 3,893,669 | 7/1975 | Myers | 273/26 E |
| 3,904,199 | 9/1975 | Burchett | 273/29 A |
| 4,010,950 | 3/1977 | Visockis . | |
| 4,105,204 | 9/1978 | Koenig | 273/29 A |
| 4,191,372 | 3/1980 | Keller | 273/29 A |
| 5,100,134 | 3/1992 | Becker | 273/29 A |
| 5,271,618 | 12/1993 | Malwitz | 273/26 E |

FOREIGN PATENT DOCUMENTS

| | | | |
|---|---|---|---|
| 2226599 | 1/1973 | Germany | 273/29 A |

*Primary Examiner*—Theatrice Brown
*Attorney, Agent, or Firm*—Kelly, Bauersfeld & Lowry

[57] ABSTRACT

A batting practice device includes a base which may be secured to a chain-link fence without the use of tools, an adjustable-length rigid arm fixed to the base and extending generally perpendicularly thereto, and a tethered free-swinging ball supported from an end of the rigid arm opposite the base. The base includes a primary support bar configured to slip between adjacent wire portions of the chain-link fence and to securely hook-on thereto, and a stabilizing crossbar generally perpendicular to the primary support bar. The rigid arm includes a first arm member rigidly fixed to the base, and a second arm member that telescopes with respect to the first arm member for the purpose of adjusting the length of the rigid arm. The ball is attached to a reinforced line which extends through the second end of the rigid arm. The length of the reinforced line is adjustable, and extends from the second end of the rigid arm centrally therethrough to the base.

14 Claims, 2 Drawing Sheets

FIG. 1
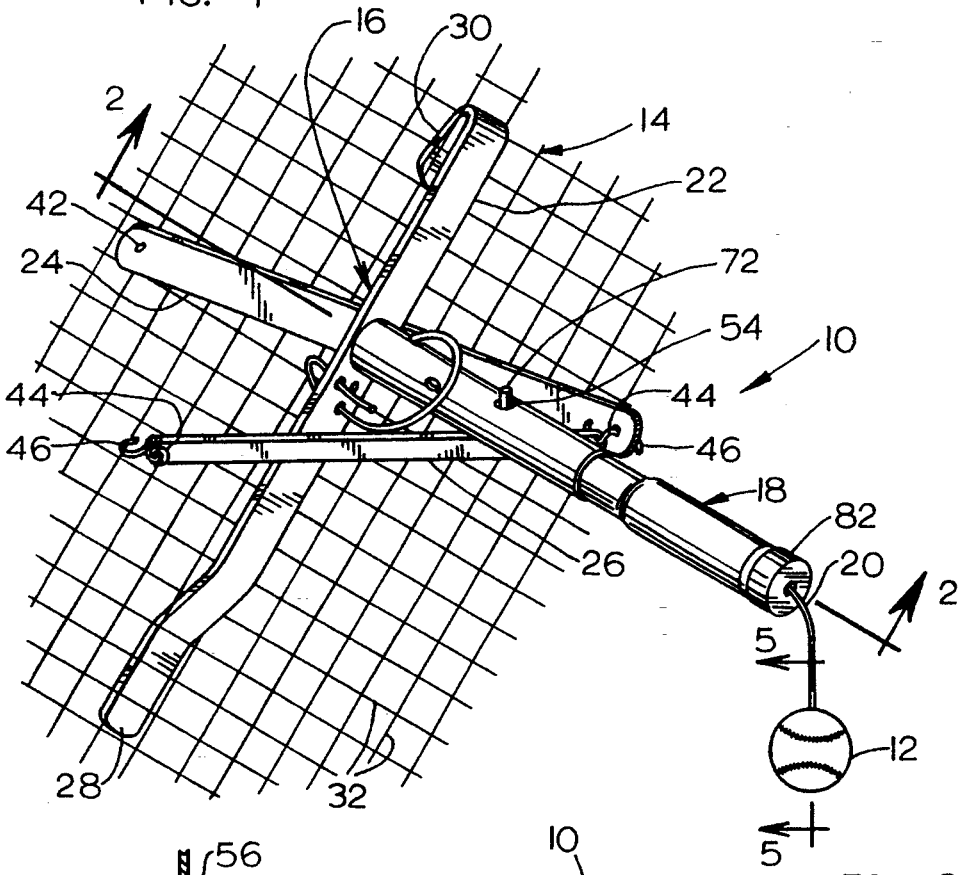
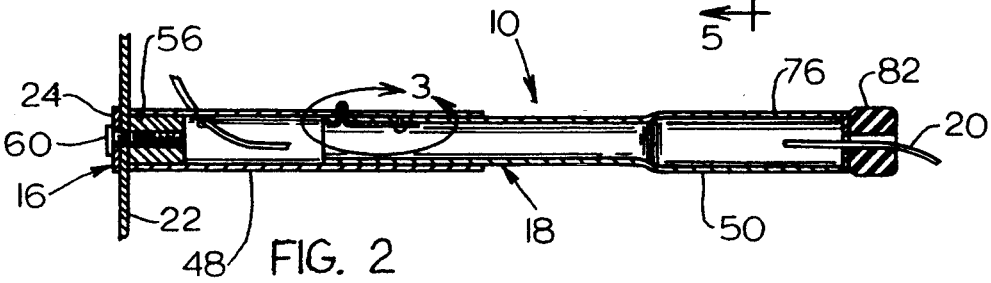
FIG. 2
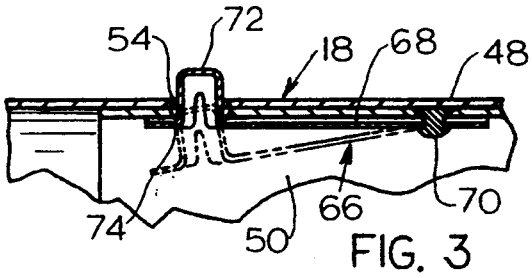
FIG. 3
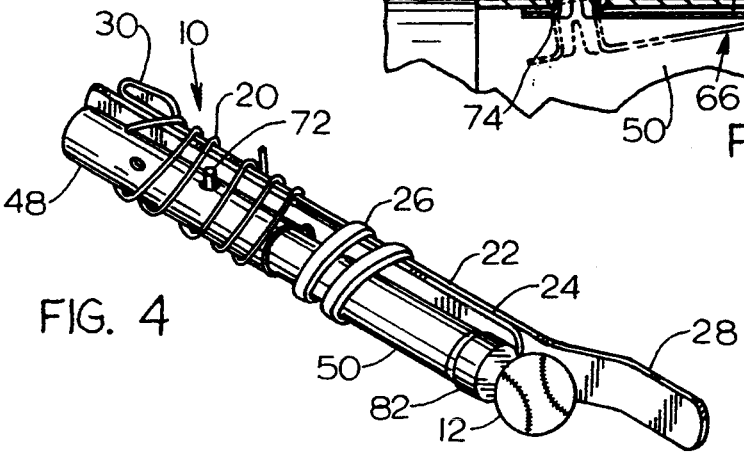
FIG. 4

BASEBALL BATTING PRACTICE DEVICE

BACKGROUND OF THE INVENTION

This invention relates generally to sports devices designed for sharpening skills involving swinging at a ball while it is midair. More specifically, the present invention relates to a device which allows a baseball player to practice batting in a relatively confined space.

It is generally agreed that the most important factors in hitting a baseball well are timing, watching the ball and knowing the strike zone. Like any other sport, baseball requires constant practice. However, it is difficult in many cases for a batter to get as much practice as he needs to become really proficient. Even after a baseball player has acquired a level swing and developed a level of proficiency at batting, his batting skills must be continuously reinforced in order that the player maintain the best batting record during competitive play.

Batting practice, of course, is a time-honored pregame activity, and additional attention is devoted to it during most practice sessions. Pitching machines have made it possible for a baseball player to get more of the practice necessary to develop a proper stance and a good swing. In both cases, however, the practice sessions require not only the batting practice pitcher or the pitching machine, but a baseball diamond and outfielders to retrieve the batted balls.

In many situations it is desirable to provide some means for a ball player to work on his hitting, and particularly his stance and swing, in a limited or confined space and in a manner which does not require that the ball be retrieved after each swing. In an effort to provide such a practice system, a number of devices have been developed. Although these prior devices, which generally provide some type of support structure rigidly fixed to a wall, fence or pole and which support a tethered ball, perform generally satisfactorily when use as intended, they each suffer drawbacks which make them less than ideal for routine, everyday use by individuals and baseball teams. For example, many of the prior baseball batting practice devices must be rigidly fixed to a wall or fence prior to use in a manner which makes it virtually impossible to conveniently set up the practice device when needed, take it down after the batting practice and then transport the practice device to another location.

Accordingly, there has been a need for a novel baseball batting practice device which can be quickly and easily mounted to and removed from chain link fences which typically surrounding portions of baseball fields. Additionally, such a novel batting practice device is needed which may be configured to fit within standard baseball equipment bags for transport from one location to another. Moreover, a baseball batting practice device is needed which, after it is placed onto a wall or fence, may be adjusted to meet the needs of a particular batter. The present invention fulfills these needs and provides other related advantages.

SUMMARY OF THE INVENTION

The present invention resides in an improved device for supporting a ball in a free-swinging relationship to a fixed support structure. The device, which is particularly useful as a baseball batting practice device, comprises a base securable to the fixed support structure, and a rigid arm having a first end fixed to the base, wherein the arm extends generally perpendicularly from the fixed support structure. A tethered free-swinging ball is supported from a second end of the rigid arm opposite the base in a position which provides a baseball player the opportunity to conduct batting practice in a confined space.

In a preferred form of the invention, means are provided for securing the base to a chain-link fence without the use of tools. The base includes a primary support bar which is configured to slip between adjacent wire portions of the chain-link fence and to securely hook-on thereto. The base also includes a stabilizing crossbar which is situated generally perpendicular to the primary support bar, and an elastic band which is connected at one end to the crossbar, and at a second end to a portion of the chain-link fence.

The rigid arm is length-adjustable and includes a first arm member which is rigidly fixed to the base, and a second arm member that telescopes with respect to the first arm member. Means are provided for locking the position of the second arm member relative to the first arm member. The locking means includes a spring-loaded tooth which is fixed relative to one of the first and second arm members. The tooth engages an aperture in an opposite one of the first and second arm members to lock the arm members in position relative to one another.

A reinforced line extends centrally through the rigid arm from the base to the second end of the rigid arm. The reinforced line is attached to the ball, and the length of the reinforced line between the ball and the second end of the rigid arm is adjustable. The base has a plurality of apertures which provide means for anchoring a portion of the reinforced line to the base.

Means are also provided for connecting the ball to an end of the reinforced line in a manner permitting shock absorption of the reinforced line relative to the ball when the ball is struck.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a perspective view of a baseball batting practice device embodying the invention and shown secured to a chain-link fence;

FIG. 2 is an enlarged, fragmented sectional view taken generally along the line 2—2 of FIG. 1;

FIG. 3 is an enlarged, fragmented sectional view of the area designated by the number 3 in FIG. 2, illustrating the manner in which a spring-loaded tooth extends through aligned apertures in a pair of telescoping tubes to fix the position of the tubes relative to one another;

FIG. 4 is a perspective view of the baseball batting practice device shown in FIG. 1, wherein the batting practice device has been removed from the chain link fence and broken down to reduce its size for improved portability;

DETAILED DESCRIPTION OF THE PREFERRED EMBODIMENT

Figure 6:
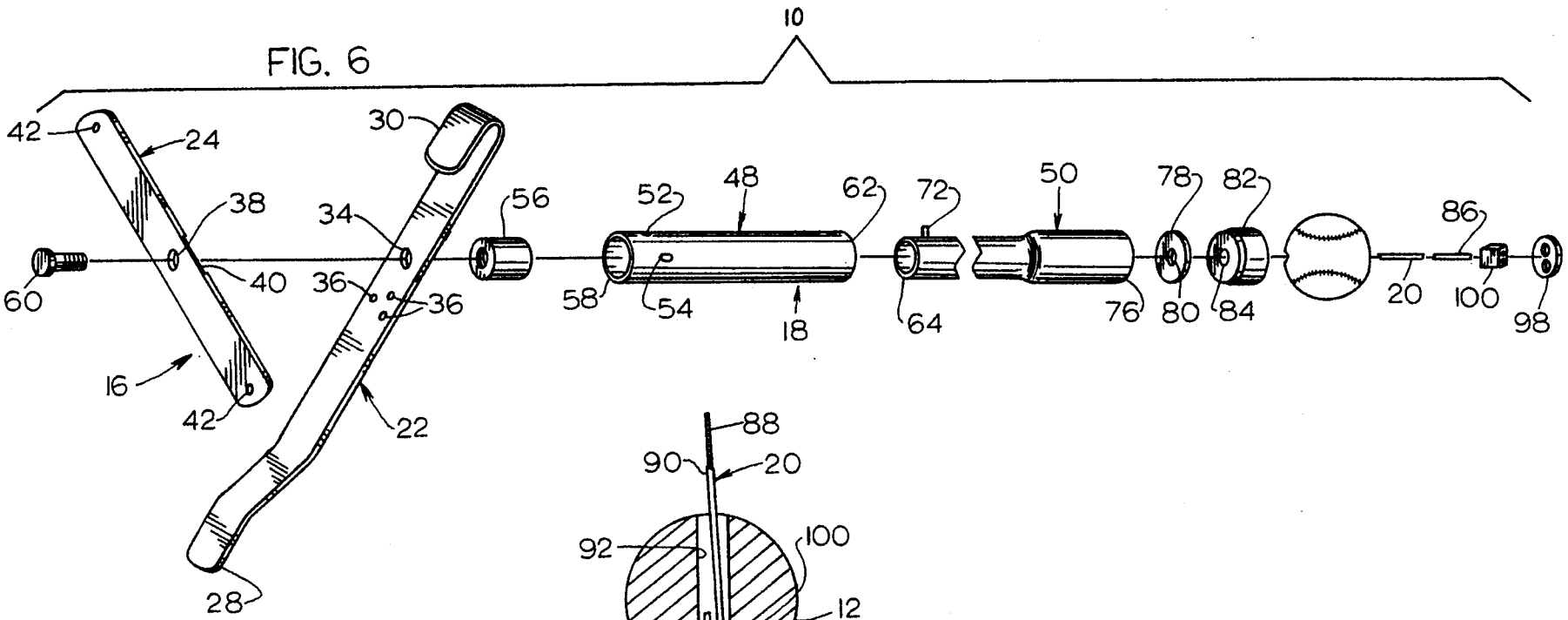
FIG. 6 is an exploded perspective view of the primary components of the baseball batting practice device shown in FIG. 1.
Figure 5:
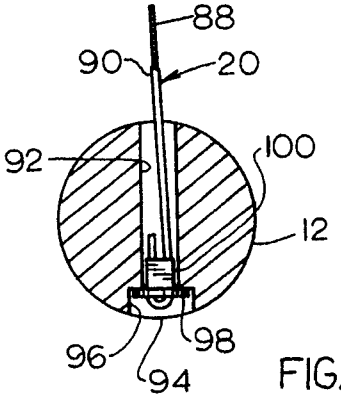
FIG. 5 is an enlarged, fragmented and partially sectional view taken generally along the line 5—5 of FIG. 1, illustrating the manner in which the ball is attached to an end of a reinforced line.

As shown in the drawings for purposes of illustration, the present invention is concerned with an improved baseball batting practice device, generally designated by the reference number 10. The device 10 is utilized to support a ball 12 in a free-swinging relationship to a fixed support structure which is represented in FIG. 1 as a chain-link fence 14.

In accordance with the present invention, the baseball batting practice device 10 includes, generally, a base 16 which may be secured to the chain-link fence 14 without the use of tools, a rigid arm 18 which is attached to the base and extends generally perpendicularly outwardly therefrom, and the ball 12 which is attached to a reinforced line 20 which, in turn, is supported by the rigid arm 18. Importantly, in addition to being easily secured to the chain-link fence 14 and set up so that a ball player can practice his swing, the baseball batting practice device 10 can be easily removed from the chain-link fence 14 and collapsed into the configuration shown in FIG. 4 for easy transport in a standard baseball equipment bag.

The base 16 includes a primary support bar 22 which is configured to slip between adjacent wire portions of the fence 14 and to securely hook-on thereto, a stabilizing crossbar 24 which is positioned generally perpendicular to the primary support bar, and an elastic band 26 which extends between an end of the crossbar and a portion of the chain-link fence across the primary support bar. More particularly, the primary support bar 22 includes a tongue portion 28 at one end and a hook portion 30 at another end. The tongue and hook portions 28 and 30 of the primary support bar 22 are designed to fit within the intersects of the chain-link fence 14 between adjacent wires 32 to contact the backside of the chain-link fence. A large central aperture 34 is provided through the primary support bar 22, and a plurality of small apertures 36 are also provided in the primary support bar 22 for the purpose of anchoring the reinforced line 20 to the base 16.

The crossbar 24, like the primary support bar 22, includes a large central aperture 38 which is aligned with the large central aperture 34. A cut-out 40 is provided in one side of the, crossbar 24 at the location of the central aperture 38, which is designed to receive a portion of the primary support bar 22 therein and securely hold the primary support bar and the crossbar 24 perpendicularly to one another. Additional small apertures 42 are provided adjacent to the ends of the crossbar 24 for purposes of attaching the elastic band 26 thereto.

The elastic band 26 is preferably constructed of a heavy rubber-like material which includes an aperture 44 at each end. An S-hook 46 is placed through each of the apertures 44 in the elastic band 26, and one of these S-hooks is also placed through one of the small apertures 42 through an end of the crossbar 24. The elastic band 26, as shown in FIG. 1, is then pulled tightly over an exposed portion of the primary support bar 22, and the free S-hook 46 is then hooked onto the chain-link fence 14. It has been found that this particular method of attaching the base 16 to the chain-link fence 14 provides a means for securely fixing the baseball batting practice device 10 to the fence without the use of tools, in a manner which can be quickly and easily disassembled and disassociated from the fence to enhance the portable characteristics of the batting practice device 10.

The rigid arm 18 includes, generally, a first cylindrical tube 48 which is fixed to the base 16, and a second tube 50 which telescopes within the first tube 48 for purposes of adjusting the length of the rigid arm 18. The first tube 48 includes a wire passageway aperture 52 through which the reinforced line 20 extends, and a plurality of arm length positioning apertures 54 which are axially and circumferentially spaced from one another along the surface of the first tube 48. A nut 56 is positioned within a first end 58 of the first tube 48 for receiving a bolt 60 utilized to attach the base 16 to the first tube 48.

The second end 62 of the first tube 48 is open to receive therethrough a first end 64 of the second tube 50. This first end 64 of the second tube 50 includes a lock assembly 66 for fixing the position of the second tube 50 relative to the first tube 48. As shown best in FIG. 3, the lock assembly 66 comprises a spring 68 positioned along an interior surface of the second tube 50 and connected thereto by a rivet connector 70. The spring 68 includes a tooth 72 which extends through an aperture 74 provide in the wall of the second tube 50. When the aperture 74 is aligned with one of the length positioning apertures 54 in the first tube 48, the spring 68 forces the tooth 72 through the aligned apertures to prevent relative movement of the second tube 50 relative to the first tube 48. This simple arrangement conveniently permits the positioning of the second tube 50 relative to the first tube 48 to be changed by depressing the tooth 72 with a finger sufficiently to clear the tooth 72 of the length positioning aperture 54. The user then simply pulls, pushes and/or twists on the second tube 50 relative to the first tube 48, during which time the upper surface of the tooth 72 simply rides along an inner surface of the first tube 48, until it is again aligned with a desired one of the length positioning apertures 54 to fix the length of the rigid arm 18.

A second end 76 of the second tube 50 has attached thereto a rigid end piece 78 which has a large central aperture 80. A cap 82 also having a large central aperture 84 is attached to the end piece 78 such that the central apertures 80 and 84 are aligned with one another. The cap 82 is preferably constructed of a material designed to minimize wear on the reinforced line 20 at the point it exits the cap (and the rigid arm 18) during use of the baseball batting practice device 10.

The reinforced line 20 extends from the base 16 through the wire passageway 52 wherein it enters the interior of the rigid arm 18. The reinforced line 20 extends substantially the entire length of the rigid arm 18 through the cap 82 to a terminal end 86 within the ball 12. The reinforced line 20 is preferably constructed of a metal wire 88 ensheathed by plastic tubing 90.

The ball 12 preferably is dimensioned and configured to match standard baseball or softball sizes and weights. The ball 12 is provided with a central bore 92 extending diametrically through the ball. Adjacent to a first opening 94 is a counter bore portion 96 in which is positioned a resilient plug 96 which is designed to absorb shock of the reinforced line 20 relative to the ball 12 when the ball is struck by a bat or the like. The end of the reinforced line 24 situated within the ball 12 is threaded through a line clamp 100 and the resilient plug 98 to securely position the terminal end 86 of the reinforced line 20 within the central bore 92.

When used, the baseball batting practice device 10 is first configured as shown in FIG. 1 such that the primary support bar 22 and the crossbar 24 of the base 16 are fixed perpendicularly with respect to one another, and such that the rigid arm 18 is secured to the base by the bolt 60. The tongue portion 28 of the primary support bar 22 is then inserted between wires 32 of the chain-link fence 14, and then the hook portion 30 is pushed up against the chain-link fence to permit an adjacent wire 32 to be slidably received therein as the primary support bar 22 is pulled downwardly toward the tongue portion 28. The base 16 is then in a fixed position relative to the chain-link fence. The elastic band 26 is stretched between one end of the crossbar 24, over an exposed portion of the primary support bar 22, and hooked, utilizing the S-hooks 46, to a wire 32 of the chain-link fence 14 as shown.

Depending on the preferences of the batter or his coach, the length of the rigid arm 18 is adjusted by sliding the second tube 50 into and out of the first tube 48, and locking the relative positions of these tubes utilizing the lock assembly 66. The height of the ball 12 can then be adjusted by threading the reinforced line 20 through the rigid arm 18. In this regard, the frictional contact between the reinforced line 20 where it enters the rigid arm 18 at the wire passageway 52 and where it exits the rigid arm at the cap 82 provides sufficient resistance to movement of the reinforced line 20 that some exertion is required to adjust the height of the ball 12 as described. When the ball 12 has been properly positioned, the end of the reinforced line 20 adjacent to the base 16 is then threaded through the small apertures 36 provided in the primary support bar 22. This effectively prevents the reinforced line 20 from moving through the rigid arm 18 any further, and thus effectively fixes the length of the reinforced line extending between the ball 12 and the cap 82.

From the foregoing it is to be appreciated that the baseball batting practice device 10 can be effectively utilized in a confined space by a baseball player to develop and reinforce those batting skills necessary to the game. The device 10 enables both experienced and inexperienced baseball players to maintain and develop those batting skills in an environment which does not require a pitcher or pitching machine and fielding personnel. Additionally, after the baseball batting practice device 10 has been removed from the chain-link fence 14, the bolt 60 may be loosened to permit various components of the device 10 to be conveniently stored as shown in FIG. 4 in a manner which improves the portability of the device and which allows the device to be conveniently thrown into a team equipment bag and transported with the bats, balls, etc., from practice to practice and to games.

Although a particular embodiment of the invention has been described in detail for purposes of illustration, various modifications may be made without departing from the spirit and scope of the invention. Accordingly, the invention is not to be limited, except as by the appended claims.

I claim:

1. A system for supporting a ball in a free-swinging mode, said system the device comprising:

a chain-link fence a base and a rigid arm;

said rigid arm having a first end fixed to said base and a second end having a tether means attaching a ball thereto;

means for securing said base to said chain-link fence without the use of tools to thereby support said arm generally perpendicular to said chain-link fence, said base includes a primary support bar configured to slip between adjacent wire portions of said fence and to securely hook, thereto, a stabilizing crossbar generally perpendicular to the primary support bar, and an elastic band connected at one end to the crossbar, and connectable at a second end to a portion of the chain-link fence.

2. A ball supporting system as set-forth in claim 1, wherein the rigid arm includes a first arm member rigidly fixed to the base, and a second arm member that telescopes with respect to the first arm member for the purpose of adjusting the length of the rigid arm.

3. A ball supporting system as set forth in claim 2, including means for locking the position of the second arm member relative to the first arm member.

4. A ball supporting system as set forth in claim 3, wherein the locking means includes a cantilevered spring-loaded tooth fixed relative to one of the first and second arm members, which tooth engages an aperture in an opposite one of the first and second arm members.

5. A ball supporting system as set forth in claim 1, wherein said tether means is a reinforced line extending longitudinally through the second end of the rigid arm, whereby the distance between said ball and said second end of said rigid arm is adjustable.

6. A ball supporting system as set forth in claim 5, including means for anchoring a portion of the reinforced line to the base.

7. A ball supporting system as set forth in claim 1, wherein said tether is a reinforced line, and means is provided to connect said ball to an end of a reinforced line in a manner permitting shock absorption of the reinforced line relative to the ball when the ball is struck.

8. A baseball batting practice system securable to a chain-link fence without the use of tools, said system comprising a chain-link fence:

a base securable to said chain-link fence, said base including a primary support bar configured to slip between adjacent wire portions of the fence and to securely hook thereto, a stabilizing crossbar generally perpendicular to the primary support bar, and an elastic band connected at one end to the crossbar and connectable at a second end to a portion of the chain-link fence;

a rigid tubular arm having a first end fixed to the base and extending generally perpendicularly to said base and chain-link fence when said base is secured to said chain-link fence said arm including a first arm member rigidly fixed to the base and a second arm member adjustable telescoping within said first arm member for the purpose of adjusting the length of the rigid arm, and means for locking the position of the second arm member to the first arm member; and a tethered ball supported from a second end of the rigid arm opposite the base, by a tether means, said tether means being a reinforced line extending longitudinally through said tubular rigid arm, whereby the distance between said ball and said second end of said rigid arm is adjustable.

9. A baseball batting practice system as set forth in claim 8, wherein the locking means includes a spring-loaded tooth fixed relative to one of the first and second arm members, which tooth engages an aperture in an opposite one of the first and second arm members.

10. A system for supporting a ball in a free-swinging mode said system comprising:

a chain-link fence a rigid arm and a base including a primary support bar; said support bar having a tongue at one end and a hook at its other end and configured to slip between adjacent wire portions of the fence, a stabilizing crossbar generally perpendicular to the primary support bar, and an elastic band connected at one end to the crossbar, and connectable at a second end to a portion of the fence;

said rigid arm having a first end fixed to the base and extending generally perpendicular from said fence when said base is attached to said fence; and a tethered ball supported from said second end of the rigid arm opposite the base.

11. A ball supporting system as set forth in claim 10, wherein the rigid arm is tubular and includes a first arm member rigidly fixed to the base a second arm member adjustably telescoping within said with first arm member for the purpose of adjusting the length of the rigid arm, and means for locking the position of the second arm member to the first arm member, said locking means including a cantilevered, spring-loaded tooth fixed relative to one of the first and second arm members, which tooth engages an aperture in an opposite one of the first and second arm members.

12. A ball supporting system as set forth in claim 10, wherein said tether means is a reinforced line extending longitudinally through said tubular rigid arm to the base, whereby the distance between said ball and said second end of said rigid arm is adjustable, and wherein the second end of the rigid arm is fitted with a cap means which receives said tether means through an aperture therein for minimizing wear on the reinforced line at a point it exits the second end of the rigid arm.

13. A ball supporting system as set forth in claim 12, including means for connecting the ball to an end of the reinforced line in a manner permitting shock absorption of the reinforced line relative to the ball when the ball is struck.

14. A ball hitting practice system securable to a chain-link fence, said system comprising:

a chain-link fence, a tubular rigid arm and a base said base includes a primary support bar configured to slip between adjacent wire portions of the chain-link fence, a stabilizing crossbar generally perpendicular to the primary support bar, and an elastic band connected at one end to the crossbar and connectable at a second end to a portion of the chain-link fence, the primary support bar having a tongue at one end and a hook at another end;

said rigid arm having a first end fixed to the base, said extending generally perpendicularly from said fence when said base is attached to said fence;

a tethered free-swinging ball supported from a second end of the rigid arm opposite the base by a reinforced tether line;

means said connecting the ball to an end of a reinforced line absorption of shock to said reinforced line when the ball is struck; and cap means fitted to the second end of the rigid arm, said reinforced line extending through an aperture in said cap means whereby wear on the reinforced line is minimized at a point said line exits the second end of the rigid arm.

* * * * *

UNITED STATES PATENT AND TRADEMARK OFFICE

CERTIFICATE OF CORRECTION

PATENT NO. : 5,386,986

DATED : February 7, 1995

INVENTOR(S) : Ricardo Gamboa

It is certified that error appears in the above-identified patent and that said Letters Patent is hereby corrected as shown below:

Col.5, line 66, claim 1, delete "the device"; column 6, line 7, delete "includes" and insert --including--.

Col.6, line 37, In claim 7, after "tether" insert --means--; line 37, after "means" delete "is" and insert --are--; line 38, delete "a" and insert --said--; line delete "the" and insert --said--; and line 40, delete "the" (both instances) and insert --said-- (both instances).

Col.6, line 42, claim 8, lines 43 and 44, delete "securable to a chain-link fence without the use of tools, said system"; line 3, delete "a chain-link fence"; between lines 3 and 4, insert as a new paragraph --a chain-link fence;--; line 4, after "fence," insert --without the use of tools--; line 11, delete "the" and insert --said--; line 12, after "rigid" insert --,--; line 15, after "fence" insert --,--; line 17, delete "adjustable" and insert --adjustably--; and line 23, after "base" delete ",".

Col.7, line 7, claim 10, line 2, after "mode" insert --,--; line 3, after "arm" insert --;--; line 3, delete "and"; and line 4, delete ";" and insert --,--.

Col.7, line 25, claim 11, line 4, delete "with".

UNITED STATES PATENT AND TRADEMARK OFFICE

CERTIFICATE OF CORRECTION

PATENT NO. : 5,386,986

DATED : February 7, 1995

INVENTOR(S) : Ricardo Gamboa

It is certified that error appears in the above-identified patent and that said Letters Patent is hereby corrected as shown below:

Col.8, line 13, claim 14, line 3, after "base" insert --;--; line 4, delete "includes" and insert --including--; line 12, delete "the base, said" and insert --said base and--; line 15, delete "free-swinging"; line 18, delete "said"; line 18, delete "a" and insert --said--; and line 19, after "line" insert --for--.

Signed and Sealed this

Second Day of April, 1996

Bruce Lehman

*Attest:*

BRUCE LEHMAN

*Attesting Officer*

*Commissioner of Patents and Trademarks*